US008544216B1

(12) United States Patent
Hazlett

(10) Patent No.: US 8,544,216 B1
(45) Date of Patent: Oct. 1, 2013

(54) PORTABLE CORRUGATED PLASTIC SHELTER

(76) Inventor: David Hazlett, Midlothian, VA (US)

( * ) Notice: Subject to any disclaimer, the term of this patent is extended or adjusted under 35 U.S.C. 154(b) by 58 days.

(21) Appl. No.: 13/214,287

(22) Filed: Aug. 22, 2011

Related U.S. Application Data

(60) Provisional application No. 61/376,770, filed on Aug. 25, 2010.

(51) Int. Cl.

| | |
|---|---|
| ***E04H 1/00*** | (2006.01) |
| ***E04H 15/18*** | (2006.01) |
| ***E04H 15/48*** | (2006.01) |
| ***E04B 1/346*** | (2006.01) |
| ***E04B 1/00*** | (2006.01) |
| ***B65D 5/12*** | (2006.01) |
| ***B65D 5/00*** | (2006.01) |
| ***A63H 33/08*** | (2006.01) |
| ***A63H 33/30*** | (2006.01) |

(52) U.S. Cl.
USPC .. 52/79.5; 52/70; 52/71; 52/270; 229/122.23; 229/126; 446/109; 446/478; 135/97; 135/148; 135/143

(58) Field of Classification Search
USPC ..... 52/71, 79.5, 270, 284, 57; 229/122.23, 229/126; 446/109, 478; 135/87, 97, 148, 135/116, 905, 143
See application file for complete search history.

(56) References Cited

U.S. PATENT DOCUMENTS

| | | | | | |
|---|---|---|---|---|---|
| 1,630,117 | A | * | 5/1927 | Faulkner | 446/76 |
| 2,131,349 | A | * | 9/1938 | Kreider, Jr. | 446/69 |
| 3,581,708 | A | * | 6/1971 | Beck et al. | 119/499 |
| 3,724,473 | A | | 4/1973 | Moss | |
| 3,766,693 | A | | 10/1973 | Richards, Jr. et al. | |
| 3,861,356 | A | * | 1/1975 | Kulka | 119/482 |
| 4,073,105 | A | * | 2/1978 | Daugherty | 52/169.9 |
| D281,917 | S | * | 12/1985 | Myers et al. | D30/110 |
| 4,603,658 | A | | 8/1986 | Garnsey | |
| 4,792,082 | A | * | 12/1988 | Williamson | 229/103 |
| 4,933,019 | A | | 6/1990 | Peruski | |
| 4,964,249 | A | | 10/1990 | Payne | |
| 5,172,525 | A | | 12/1992 | Cook | |
| 5,383,422 | A | * | 1/1995 | Morris | 119/499 |
| 5,465,686 | A | | 11/1995 | Monetti et al. | |
| 5,566,514 | A | * | 10/1996 | Freller | 52/79.5 |
| 5,752,470 | A | | 5/1998 | Koneke | |

(Continued)

OTHER PUBLICATIONS

U.S. Appl. No. 10/371,114, filed Feb. 24, 2003, Helen Sue Martin, Eddie Glen Martin.

(Continued)

*Primary Examiner* — Phi A
*Assistant Examiner* — Omar Hijaz
(74) *Attorney, Agent, or Firm* — Sheldon H. Parker, Esq.

(57) ABSTRACT

A portable shelter made from two corrugated plastic sheets. Each sheet has score lines that define a floor panel, two wall panels, and two roof panels. The two sheets are overlapped, and the panels are bent along the score lines to form the walls and roof. Each panel is secured to the adjacent panel with tabs and seam members to form standing seams that are secured by fasteners. An opening in the roof provides ventilation, while a cap over the opening blocks precipitation from entering. The entire structure is secured in place with stakes that are inserted through the floor into the ground. Solar panels can be affixed to the shelter to provide electrical power.

16 Claims, 3 Drawing Sheets

(56) References Cited

U.S. PATENT DOCUMENTS

| | | | | |
|---|---|---|---|---|
| 5,791,554 | A * | 8/1998 | Jensen | 229/148 |
| 6,085,475 | A * | 7/2000 | Parks et al. | 52/169.6 |
| 6,230,729 | B1 | 5/2001 | Carter | |
| 6,250,021 | B1 * | 6/2001 | Ferrara, Jr. | 52/71 |
| 6,305,599 | B2 * | 10/2001 | Tsubaki et al. | 229/122.23 |
| 6,895,898 | B1 * | 5/2005 | Kitch | 119/474 |
| 6,981,916 | B2 * | 1/2006 | Coulton | 454/365 |
| 7,552,563 | B2 * | 6/2009 | Becker | 52/79.5 |
| 7,984,596 | B1 * | 7/2011 | Simpson et al. | 52/520 |
| 2007/0228127 | A1 * | 10/2007 | Gardner | 229/122.23 |

OTHER PUBLICATIONS

U.S. Appl. No. 11/263,424, filed Oct. 31, 2005, Wayne H. Rothschild, Maxwell Bell R.

U.S. Appl. No. 11/011,381, filed Dec. 14, 2004, Patrick Michael Flanagan.

U.S. Appl. No. 11/925,195, filed Oct. 26, 2007, Max W. Durney, Radha Vaidyanatha.

* cited by examiner

PORTABLE CORRUGATED PLASTIC SHELTER

BACKGROUND OF THE INVENTION

1. Field of the Invention

The invention relates to portable shelters, and is particularly directed to foldable shelter structures made from lightweight and inexpensive insulated materials that are easily assembled, have a small footprint, and are strong enough for heavy use.

2. Description of Related Art

Temporary shelters that can be easily transported and rapidly set up at emergency sites can be particularly useful in providing temporary care and housing. Such shelters can also be useful for non-emergency outdoor gathers, such as hunting, children playing, and the like.

Conventional portable shelters are for the most part fabric tent structures requiring the use of fabric, stakes, guys, and structural support members. The fabrics are not rigid and are prone to rotting, while the metal supports are prone to rusting. Such structures are bulky when disassembled for transportation, and require substantial time to erect.

SUMMARY OF THE INVENTION

The invention is a portable shelter that is low-cost to produce, easy to transport, and easy to erect. This is accomplished by having two corrugated plastic sheets with identical perimeters that have longitudinal axis allowing them to be cut from sheets of corrugated plastic with little waste. The two sheets are overlapped, with the overlapped section forming the floor. The walls are bendable along score lines to form wall and roof panels. Each wall and roof panel has a tab side and a seam side. When two adjacent panels are erected a tab side of one panel and the seam side of the adjacent panel meet and can be connected to form a standing seam. The standing seam is secured using fasteners to create a weather-resistant seam.

The roof of the shelter has an opening in the roof that helps circulate air and provide ventilation. A cap covers the opening to prevent rain or snow from entering the shelter, but has enough of a gap with the roof to still function as a vent.

The portable shelter has stakes inserted through the floor that secure the shelter to the ground and prevent it from being tipped over or otherwise moving.

The portable shelter can have solar panels that affix to a wall or roof to provide power to the shelter, allowing it to run fans, appliances, or charge batteries to power lights at night.

The shelter can have a second doorway, this enables two shelters to be connected together to form a single larger shelter.

DETAILED DESCRIPTION

Figure 1A:
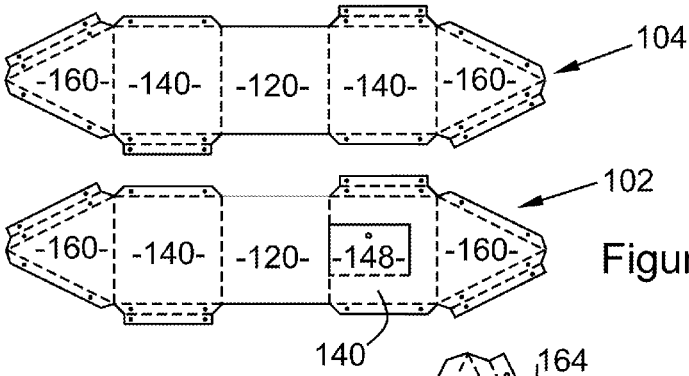
FIG. 1*a* is a top view the two corrugated plastic sheets separated

The shelter can made from two separate sheets of corrugated plastic. The use of two separate sheets enables the use of commercially available sheets, and makes the cost of the corrugated plastic sheets low. Corrugated plastic provides insulation for the shelter in addition to be light weight, rigid, weather-resistant and durable. Materials with comparable attributes may also be used, as for example water proofed corrugated paper board. Any corrugated plastic may be used. Transparent or semi-transparent corrugated plastic can be used to enable the shelter to function as a green house. Biodegradable corrugated plastic can be used so the shelter does not need to be disassembled. Corrugated plastic with ultraviolet (UV) treatment is preferred to extend the life of the plastic in an outdoor setting. Other treatments such as flame retardation can be used based on the intended use of the shelter. The thickness of the corrugated plastic will need to be increased as the dimensions of the shelter are increased.

The first sheet 102 and the second sheet 104 have the same perimeter, but can vary on the interior cuts that include doors, windows, vents, or similar cuts or scores. The first sheet 102 is overlapped by the second sheet 104 to form a cross 108.

The overlapping sheets create a two layer floor 120 providing additional insulation and strength by creating a cross-grain in the corrugated fluting. Once overlapped, the cross structure 100 has four wall panels 140 connected to the two floor panels 120 and four roof panels 160 attached to the four wall panels 140.

The floor panel created from sheet 102 has the flutes of the corrugations at right angles to the flutes for the floor panel created from sheet 104. This provides structural strength characteristics of plywood.

Figure 1B:
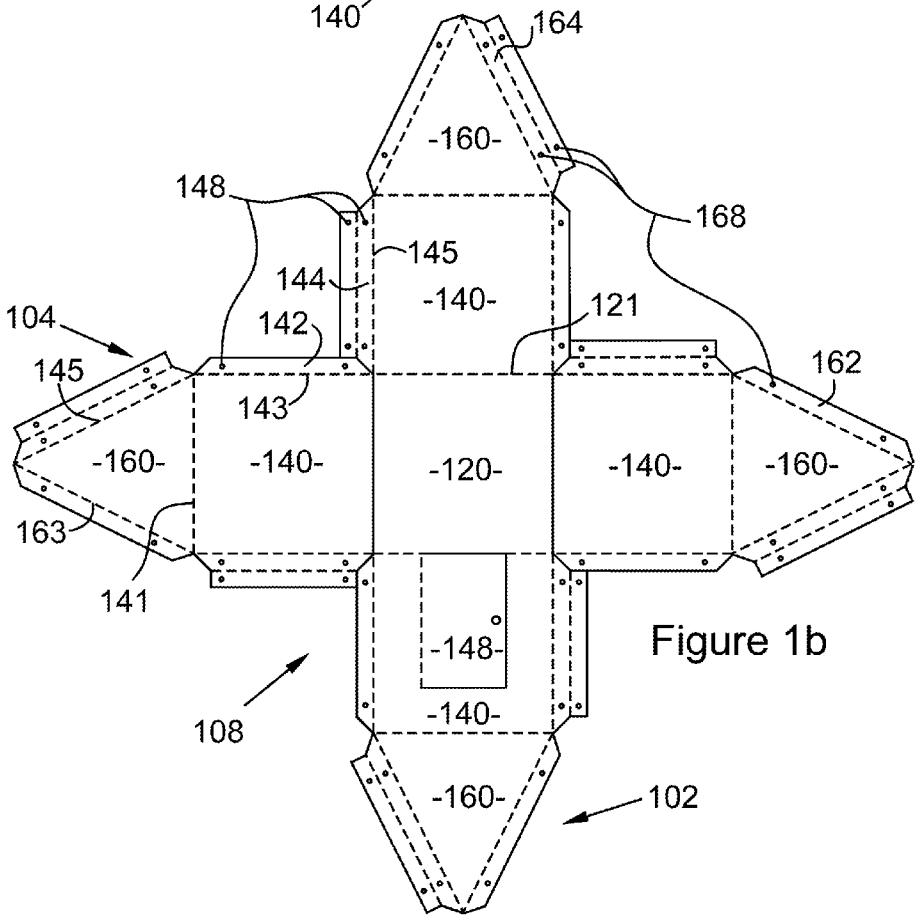
FIG. 1*b* is a top view of the two corrugated plastic sheets overlapping
Figure 2:
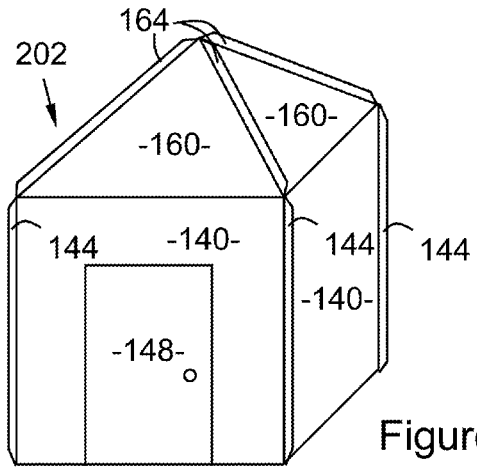
FIG. 2 is a perspective view of the completed shelter
Figure 3:
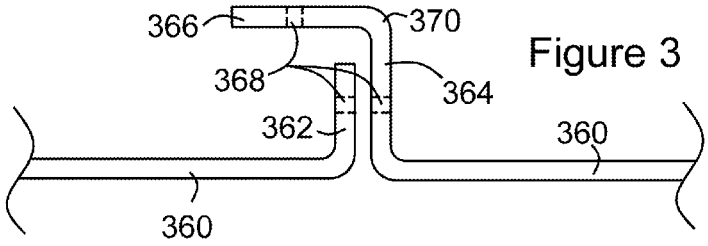
FIG. 3 is a side view of a panel with a tab and a panel with a seam
Figure 4:
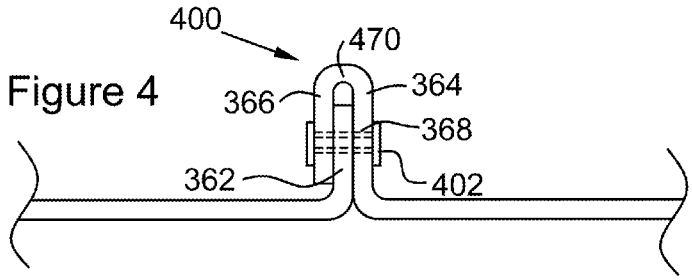
FIG. 4 is a side view of the seam receiving the tab to create a standing seam
Figure 5:
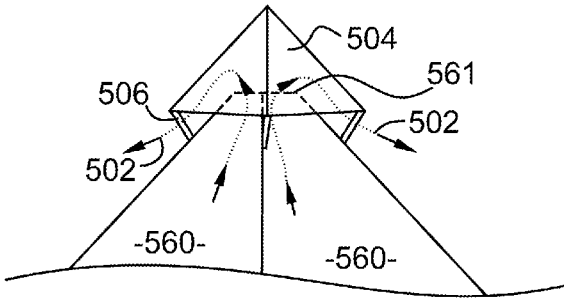
FIG. 5 is a perspective view of the top vent

Each wall panel 140 has two horizontal edges formed by scoring 121, a lower floor-wall scoring 141 and an upper wall-roof scoring 141. Each wall panel also has a first and second vertical edge formed by the edge of the sheet. The first edge has a tab 142 that extends beyond the area of the wall panel 140. The two cut corners can be acute, obtuse, or right angles. The two angles do not need to be identical to one another. FIG. 1*b* depicts a tab 142 with an acute angle. In the preferred embodiment, obtuse angles are preferred, particularly for the roof panels 106, to provide additional water resistance properties. A score 143 separates the tab 142 and the wall panel 140. The second edge has a seam 144 that receives the tab 142 to form a standing seam. A score 145 separates the seam 144 from the wall panel 140.

Each roof panel 160 has one edge formed by scoring 141, and a first and second edge formed by the edge of the sheet. The first edge has a tab 162 that extends beyond the area of the roof panel 160. A score 163 separates the tab 162 from the roof panel 160. The second edge has a seam 164 that receives the tab 162 to form a weather resistant standing seam. The holes 148 in the wall tab 142 and wall seam 144 align, allowing a fastener to fit through the wall holes 148 to secure the standing seam. Similarly, the roof holes 168 in the roof tab 162 and roof seam 162 align, allowing a fastener to fit through the roof holes 168 to secure the standing seam. A score 145 separates the seam 164 from the roof panel 160.

The standing seam is made up of two adjacent panels 360, one having a tab 362, and one having a seam. The seam is formed by a first seam section 364 that is similar in size to the adjacent tab 362 and a second seam section 366 separated by a score 370. The tab 362, the first seam section 364 and the second seam section 366 have at least one hole 368 that accepts a fastener.

The standing seam 400 is formed by aligning the tab 362 next to the first seam section 364 putting the score 470 into a bent position to place the second seam section 366 in parallel with the tab 362 to align the hole 368. A fastener 402 is placed through the hole 368 to lock the tab 362, the first seam section 364 and the second seam section 366 to form a standing seam 400. The fastener can be clips, clamps, staples, rivets, nuts and bolts, zip ties and their equivalents. In the preferred embodiment, the fastener does not require tools to secure, and is non-permanent to allow the structure to be taken down. Alternatively, weather resistant adhesives can be used.

Once all of the wall panels and roof panels have been raised and fastened, it forms an assembled structure 202 that can be used as a shelter.

Figure 6:
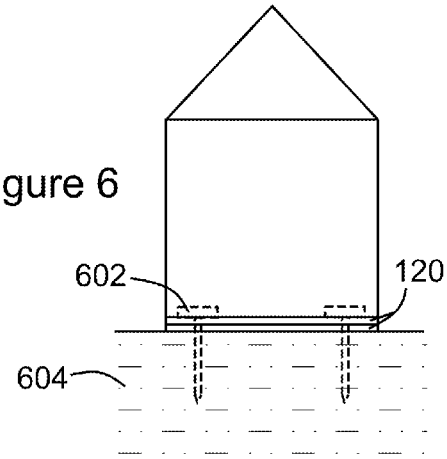
FIG. 6 is a side view of the shelter with stakes

As seen in FIG. 6, a gap 561 formed by truncating the roof at the peak of the roof allows the ventilation of air 502. A cap 504 covers the gap 561 and extends beyond the gap 561 to prevent precipitation from entering the shelter. The cap is secured to one or more roof panels 160 and can be offset from the roof by strut members 506 or any equivalent spacer member. There is a space between the roof panels 560 and the cap 504 to allow the passage of air 502 that rises from the shelter and escapes out the gap 561.

As seen in FIG. 6, stakes 602 are passed through the floor panels 120 into the ground 604 to secure the shelter to the ground. This eliminates the need for cables, and narrows the footprint of the shelter.

Figure 7:
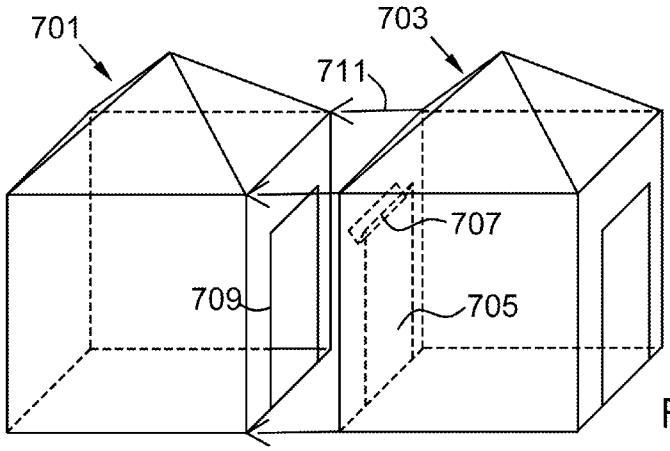
FIG. 7 is a perspective view of combining a one-door shelter and a two-door shelter

As seen in FIG. 7, a one-door shelter 701 can be combined with a two-door shelter 703 to form a larger multi-room shelter. The two-door shelter has a second doorway 705 with a seam member 707 along one or all of the doorway edges. The one-door shelter 701 is moved into position next to the two-door shelter 703 as shown by the arrows 711. The seam member 707 receives the doorway 709 of the one-doorway house to form a standing seam. The multi-room shelter is valuable, for example, when shelter is needed for a large family. Multiple two-door, or potentially three-door or four-door shelters can be combined to add even more rooms to the shelter.

What is claimed is:

1. A weather resistant shelter comprising:

a) a first corrugated sheet having a first longitudinal axis and a floor panel, a first wall panel connected to a first edge of the floor panel, a second wall panel connected to a second opposing edge of the floor panel, a first roof panel connected to the first wall panel, and a second roof panel connected to the second wall panel, and a second corrugated sheet having a second longitudinal axis and a floor panel, a first wall panel connected to a first edge of the floor panel, a second wall panel connected to a second opposing edge of the floor panel, a first roof panel connected to the first wall panel, and a second roof panel connected to the second wall panel, said first corrugated sheet and said second corrugated sheet have identical peripheries, b) the first corrugated sheet and the second corrugated sheet being oriented so that said first longitudinal axis and said second longitudinal axis are perpendicular to each other and the floor panels overlap each other, c) each wall panel having a first edge and a second edge, the first edge having a tab, the second edge having a foldable seam member having a score line with the tab of each wall panel received by the seam member of the adjacent wall panel of the shelter proximate the score line, said fordable seam member being folded over the tab to form a standing seam, d) each roof panel having a first edge and a second edge, the first edge having a tab, the second edge having a foldable seam member having a score line with the tab of each roof panel received by the seam member the adjacent roof panel of the shelter proximate the score line, said fordable seam member being folded over the tab to form a standing seam.

2. The shelter of claim 1, where the corrugated sheet is plastic.

3. The shelter of claim 1, further comprising a solar panel affixed to at least one wall panel or one roof panel to provide electric power.

4. The shelter of claim 1, further comprising a wall panel having a first doorway opening and a first door hinged to the wall panel.

5. The shelter of claim 4, wherein the shelter has a second doorway opening having a foldable seam member that receives the first doorway opening of a second shelter to form a standing seam.

6. The shelter of claim 1, wherein the corrugated sheet is plastic and further comprising:

a) a solar panel affixed to at least one wall panel or one roof panel to provide power, b) a wall panel having a first doorway opening and a first door hinged to the wall panel.

7. The method of assembling a weather resistant shelter, the shelter being formed from:

a) a first corrugated sheet having a first longitudinal axis and a floor panel, a first wall panel connected to a first edge of the floor panel, a second wall panel connected to a second opposing edge of the floor panel, a first roof panel connected to the first wall panel, and a second roof panel connected to the second wall panel, and a second corrugated sheet having a second longitudinal axis and a floor panel, a first wall panel connected to a first edge of the floor panel, a second wall panel connected to a second opposing edge of the floor panel, a first roof panel connected to the first wall panel, and a second roof panel connected to the second wall panel, said first corrugated sheet and said second corrugated sheet have identical peripheries, b) the first corrugated sheet and the second corrugated sheet being oriented so that said first longitudinal axis and said second longitudinal axis are perpendicular to each other and the floor panels overlap each other, c) each wall panel having a first edge and a second edge, the first edge having a tab, the second edge having a foldable seam member having a score line with the tab of each wall panel received by the seam member of the adjacent wall panel of the shelter proximate the score line, said fordable seam member being folded over the tab to form a standing seam, d) each roof panel having a first edge and a second edge, the first edge having a tab, the second edge having a foldable seam member having a score line with the tab of each roof panel received by the seam member the adjacent roof panel of the shelter proximate the score line, said fordable seam member being folded over the tab to form a standing seam, comprising the steps of:

a) overlapping a first corrugated sheet over a second corrugated sheet, such that said first longitudinal axis and said second longitudinal axis are perpendicular to each other, b) rotating each wall panel relative to the floor panel, c) receiving the tab of the adjacent wall panel in each wall panel seam member proximate a score line, d) folding said seam member at the score line to overlap the tab e) rotating each roof panel relative to the wall panel, f) receiving the tab of the adjacent roof panel in each roof panel seam member proximate a score line, g) folding said seam member at the score line to overlap the tab.

8. The method of claim 7, further comprising the step of securing each standing seam with at least one fastener that attaches the seam member to the tab.

9. The method of claim 8, further comprising the step of securing the shelter in place by driving at least one stake through the floor panels into a supporting surface beneath said shelter.

10. A weather resistant shelter comprising:

a) a first corrugated sheet having a first longitudinal axis and a floor panel, a first wall panel connected to a first edge of the floor panel, a second wall panel connected to a second opposing edge of the floor panel, a first roof panel connected to the first wall panel, and a second roof panel connected to the second wall panel, and a second corrugated sheet having a second longitudinal axis and a floor panel, a first wall panel connected to a first edge of the floor panel, a second wall panel connected to a second opposing edge of the floor panel, a first roof panel connected to the first wall panel, and a second roof panel connected to the second wall panel, said first corrugated sheet and said second corrugated sheet have identical peripheries, b) the first corrugated sheet and the second corrugated sheet being oriented so that said first longitudinal axis and said second longitudinal axis are perpendicular to each other and the floor panels overlap each other, c) each wall panel having a first edge and a second edge, a first doorway opening, and a first door attached to the first doorway opening, the first edge having a tab, the second edge having a foldable seam member having a score line with the tab of each wall panel received by the seam member of the adjacent wall panel of the shelter proximate the score line, said fordable seam member being folded over the tab to form a standing seam, d) each roof panel having a first edge and a second edge, the first edge having a tab, the second edge having a foldable seam member having a score line with the tab of each roof panel received by the seam member the adjacent roof panel of the shelter proximate the score line, said fordable seam member being folded over the tab to form a standing seam, e) each standing seam secured by a fastener that penetrates the seam member and tab.

11. The shelter of claim 10, where the corrugated sheet is plastic.

12. The shelter of claim 10, further comprising the roof panels forming a roof, the roof having an opening and a cover secured and spaced from the roof, whereby the cover overlaps the roof opening.

13. The shelter of claim 10, further comprising at least one stake inserted through the floor of each sheet to secure the shelter to a particular location.

14. The shelter of claim 10, further comprising solar panels affixed to at least one wall panel or one roof panel to provide power.

15. The shelter of claim 10, wherein the shelter has a second doorway opening having a foldable seam member that receives the first doorway opening of a second shelter to form a standing seam.

16. The shelter of claim 10, wherein the corrugated sheet is plastic and further comprising:

a) the roof having an opening and a cover secured and spaced from the roof, whereby the cover overlaps the roof opening, b) at least one stake inserted through the floor of each sheet to secure the shelter to a particular location, c) solar panels affixed to at least one wall panel or one roof panel to provide power.

* * * * *